US008505134B2

(12) United States Patent
Poyet

(10) Patent No.: US 8,505,134 B2
(45) Date of Patent: Aug. 13, 2013

(54) NURSING BED WITH A LATERAL MOVEMENT OF TRANSLATION

(76) Inventor: Pascal Charles Antoine Poyet, Unieux (FR)

( * ) Notice: Subject to any disclaimer, the term of this patent is extended or adjusted under 35 U.S.C. 154(b) by 586 days.

(21) Appl. No.: 12/518,853

(22) PCT Filed: Dec. 12, 2007

(86) PCT No.: PCT/FR2007/002050

§ 371 (c)(1),
(2), (4) Date: Aug. 27, 2010

(87) PCT Pub. No.: WO2008/087288

PCT Pub. Date: Jul. 24, 2008

(65) Prior Publication Data

US 2010/0313358 A1 Dec. 16, 2010

(30) Foreign Application Priority Data

Dec. 12, 2006 (FR) ..... 06 10843
Jul. 17, 2007 (FR) ..... 07 05166

(51) Int. Cl.
*A61G 7/08* (2006.01)

(52) U.S. Cl.
USPC ..... 5/81.1 HS; 5/617; 5/613; 297/423.3; 297/423.19

(58) Field of Classification Search
USPC ... 5/81.1 HS, 613, 617, 943, 601; 297/423.3, 297/43.19, 2; 378/209
See application file for complete search history.

(56) References Cited

U.S. PATENT DOCUMENTS 6,519,795 B1 * 2/2003 Liu ..... 5/617
2004/0226093 A1 * 11/2004 Nomura ..... 5/600

FOREIGN PATENT DOCUMENTS

EP 294510 A1 * 12/1988

* cited by examiner

*Primary Examiner* — Peter M Cuomo
*Assistant Examiner* — Brittany Wilson
(74) *Attorney, Agent, or Firm* — McClure, Qualey & Rodack, LLP

(57) ABSTRACT

The invention relates to a nursing bed (1) comprising a base (2) supported on the ground and a sleeping surface (3) supported by the base (2) and comprising a back rest (4), a seat part (5) and a leg rest (6), the nursing bed being characterized in that it allows for clearance with a lateral movement of translation (20), used to enable the leg rest (6) to move laterally in relation to the seat part (5), or vice versa, the seat part (5) in relation to the leg rest (6), according to a movement of translation oriented in a direction which is essentially transversal to the sleeping surface (3), in such a way as to clear the front access to the seat part (5), and a regulator for varying the seat of the seat part (5) and/or the leg rest (6) in relation to the ground.

20 Claims, 5 Drawing Sheets

1
P
$(Y_3Y'_3)$
5'
7
5
5''
$(Y_2Y'_2)$
54
51
52
$(Y_1Y'_1)$
5S
B
B
22
53
26
50
6S
6
20
21
A
A
23S
23
24
6
50
B-B 6S
53
52
51
A-A

NURSING BED WITH A LATERAL MOVEMENT OF TRANSLATION

CROSS REFERENCE RELATED APPLICATIONS

This application is a national phase of PCT/FR2007/002050 filed Dec. 12, 2007, which claims priority to French application Ser. No. 07/05166, filed Jul. 17, 2007, and French Application Serial No. 06/10843, filed Dec. 12, 2006, all of which are entirely incorporated herein by reference.

FIELD OF THE INVENTION

The present invention relates to the general technical field of nursing furniture intended to improve the comfort of the patient and to provide assistance to nursing staff during care.

The present invention relates more specifically to a nursing bed comprising a base supported on the ground and a sleeping surface supported by the base and comprising a back rest, a seat part and a leg rest.

STATE OF THE RELATED ART

In the field of medical or paramedical care, it is a known fact that patients whose mobility is restricted, for example after an injury or simply due to their old age, need to be received and treated.

In such situations, the patient is generally confined to bed for long periods of time.

In order to improve the day-to-day comfort of the patient, nursing beds have been developed which have a hinged sleeping surface, generally comprising a back rest, a seat part and a leg rest, the respective inclinations whereof can be adjusted in order to change the sleeping surface from a flat configuration for rest and a configuration similar to that of an armchair so as to facilitate certain activities such as reading, conversation or taking meals.

However, although they provide a certain level of living comfort for patients, the nursing beds of the prior art nevertheless suffer from non-negligible drawbacks.

In particular, the hinge mechanisms of existing sleeping surfaces, especially when motorized, are particularly complex, heavy and cumbersome.

Generally, such mechanisms further occupy the entire volume below the sleeping surface and may thus form an obstacle to access to the bed, both for the patient and the nursing staff.

For instance, if the patient needs be moved onto a wheelchair or placed in an upright position using a standing aid, approaching the bed is generally hindered by the fact that said wheelchairs or standing aids abut against the structure of the bed and can therefore only be positioned at a distance from the sleeping surface.

Thus, it is the task of the nursing staff to handle the patient, which may cause pain, possibly injuries, to said patient, or even cause the nursing staff to develop back pain.

DESCRIPTION OF THE INVENTION

The aims of the present invention are thus intended to remedy the abovementioned drawbacks and provide a novel nursing bed that guarantees optimized comfort for the user while having excellent accessibility.

A further aim of the present invention is to provide a novel nursing bed wherein the structure is particularly simple, compact and lightweight.

A further aim of the invention is to provide a novel nursing bed that is highly polyvalent both to satisfy the needs of the patient and to meet layout constraints or care-related requirements.

A further aim of the invention is to provide a novel nursing bed with an optimized functional safety with respect to the patient and the nursing staff.

Finally, a further aim of the invention is to provide a novel nursing bed that is particularly robust and stable.

The aims of the invention are achieved with a nursing bed comprising:

a base supported on the ground, a sleeping surface supported by the base and comprising a back rest, a seat part and a leg rest, said nursing bed being characterized in that it comprises means for clearance with a lateral movement of translation, used to enable the leg rest to move laterally in relation to the seat part, or vice versa, the seat part in relation to the leg rest, according to a movement of translation oriented in a direction which is essentially transversal to the sleeping surface, in such a way as to clear the front access to the seat part, and seat regulating means for varying the seat of the seat part and/or the leg rest in relation to the ground.

BRIEF SUMMARY OF FIGURES

Other aims, features and advantages of the invention will emerge in more detail on reading the following description and with reference to the figures that are purely illustrative and not limiting, wherein.

PREFERRED EMBODIMENT OF THE INVENTION

Figure 1:
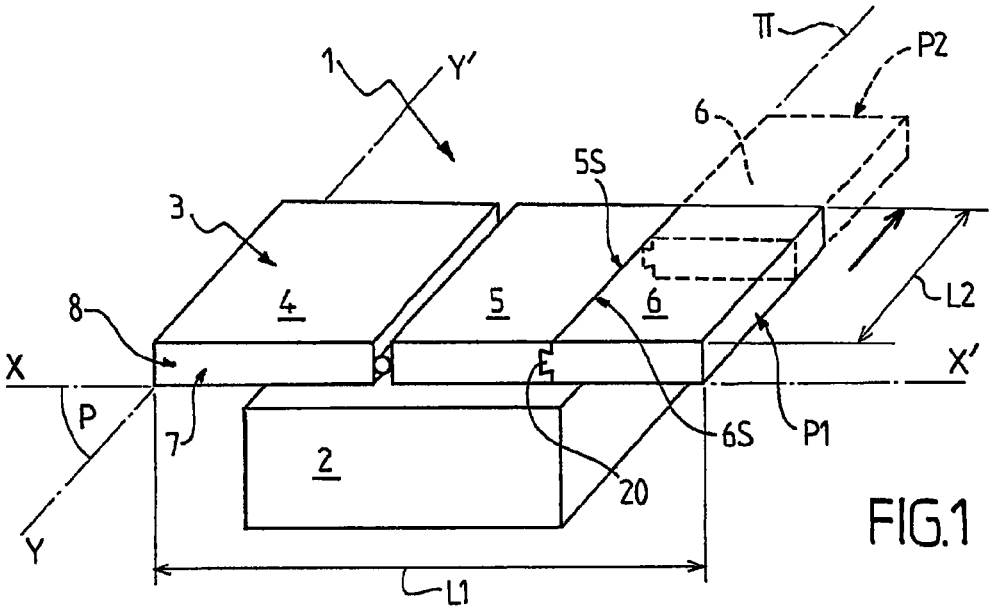
FIG. 1 is a schematic perspective view of an alternative embodiment of a nursing bed according to the invention.

The present invention relates to a nursing bed 1 for receiving a patient in order to allow same to rest and/or to receive care.

In particular, the nursing bed 1 according to the invention may be specifically adapted for use in a hospital.

For instance, the nursing bed 1 may be configured specifically for "acute care" such as intensive care or recovery.

The nursing bed 1 may also be adapted for use in obstetrics and may thus form a delivery table or even a maternity bed, for instance.

Moreover, the nursing bed 1 may of course be adapted to the patient's corpulence and may especially be designed to receive obese patients in endocrinological departments.

Finally, in an optionally simplified form from a mechanical point of view and/or more aesthetically refined form, the nursing bed 1 may also be adapted for domestic use with private patients or in residential facilities for long-term stays, such as homes for the aged or psychiatric facilities.

Thus, the nursing bed 1 according to the invention may, for instance, comprise functions for forward/backward tilting, for resting on the side, or various other accessories such as IV poles, safety bedrails, storage boxes, etc.

The nursing bed 1 of the invention comprises a base 2 supported on the ground so as to provide a stable bearing for the bed 1.

Of course, the "base" is a general term for the stand of the bed that may be fixed to, held by or rest against any suitable support means, stationary or mobile, such as the ground, a wall or a ceiling.

In addition, the nursing bed 1 comprises a sleeping surface 3 supported by the base 2, the sleeping surface 3 comprising a back rest 4, a seat part 5 and a leg rest 6.

Figure 2:
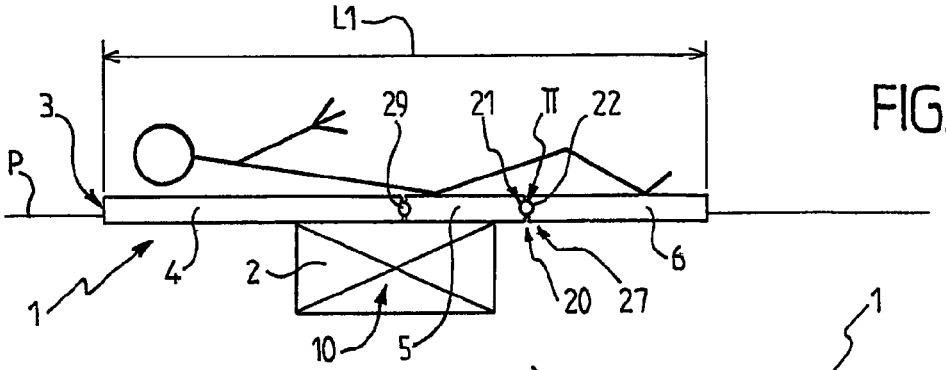
FIG. 2 is a schematic side view of an alternative embodiment of a nursing bed according to the invention in a configuration allowing a patient to lie down.

According to the invention, the sleeping surface 3 is sufficiently long to receive the entire body of a patient such that same can rest and in particular sleep in acceptable comfort on said sleeping surface 3, as illustrated in FIG. 2.

Preferably, the sleeping surface 3 comprises a bed base 7 for this purpose, formed by a frame with slats, a suspension grid or a shell of polymer or composite material, for instance, all or a part of said bed base 7 being covered by an upholstered support such as a mattress 8.

According to one alternative embodiment, the mattress 8 may be intrinsically reinforced so as to be self-supporting.

To clarify the description, in the text hereinafter, it is assumed that the bed 1 stands on a plane and horizontal ground, the sleeping surface 3 can adopt at least one substantially horizontal configuration enabling a patient to stretch out substantially parallel with the ground, and that the bed 1, and more specifically the sleeping surface 3, thus has a longitudinal direction of extension (XX') corresponding substantially to the axis of extension from the head to the feet of a patient, as well as a transversal direction of extension (YY') substantially perpendicular to the longitudinal direction of extension (XX') and forming a plane (P) therewith that is substantially parallel with the ground.

Furthermore, the base 2 preferably comprises lifting means 10 designed for a general variation of the height of the sleeping surface 3, such as a column, boom or compass-type mechanism.

Figure 4:
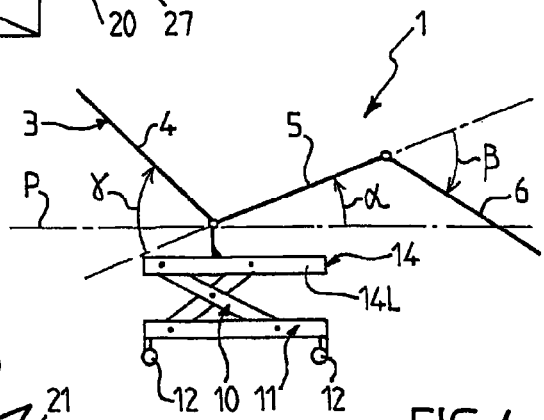
FIG. 4 is a schematic side view of an alternative embodiment of the nursing bed according to the invention.

As illustrated in FIG. 4, the base 2 may comprise a lower frame 11 supported on the ground by means of castors 12, for instance, and an upper frame 14 whereon the sleeping surface 3 is fastened, the lifting means 10 being inserted between the lower frame 11 and the upper frame 14 so as to guarantee the vertical mobility of the upper frame 14 relative to the lower frame 11.

In this context, it should be noted that the bed 1 according to the invention may be specifically designed for use in facilities receiving people suffering from forms of dementia, such as Alzheimer's disease; for such applications, the upper surface of the sleeping surface 3 is preferably situated less than 30 cm and more preferably less than 20 cm from the ground to limit the potential after-effects of any falls.

To achieve this, it may be envisaged to provide two lifting columns forming supporting beams at the head and the foot of the bed extending beyond the frame so that the space under the sleeping surface 3 is not obstructed thereby.

In one alternative embodiment, the frames 11, 14, and especially the upper frame 14, could be formed by a mechanically welded frame with longitudinal beams 14L and cross beams 14T forming a substantially plane and rectangular frame, although any other shape may be envisaged.

According to an important feature of the invention, the nursing bed 1 comprises:

means 20 for clearance with a lateral movement of translation (hereinafter referred to as "clearance means") to enable the leg rest 6 to move laterally in relation to the seat part 5, or vice versa, the seat part 5 to move laterally in relation to the leg rest 6, according to a movement of translation oriented in a direction which is substantially transversal to the sleeping surface 3, in such a way as to clear the front access to the seat part 5, as well as seat regulating means 21 for varying the orientation of the seat part 5 and/or of the leg rest 6 in relation to the ground.

Particularly advantageously, such a combination of clearance means 20 and seat regulating means 21 enables the bed 1 according to the invention, as detailed hereinafter, to offer the patient one or a plurality of comfort adjustments, in particular upright or seated positions, while at the same time enabling clearance of the access to the sleeping surface if necessary, for instance, if the patient wishes to get up, relieve their legs or if the nursing staff wish to administer care to the legs.

More specifically, the bed according to the invention, on one hand, can facilitate access to the bed by the patient and, more particularly, make it easier for the patient to regain support when getting up and, on the other, can provide free access for the nursing staff to said patient's legs, especially the back of the legs, so as to provide hygienic care (washing) or health care (changing dressings).

According to the invention, the sleeping surface 3 is separated, or at least separable, along a separation line (II) on either side whereof the seat part 5 presents a seat part separation edge 5S opposite a leg rest separation edge 6S, respectively.

Preferably, the separation line (II) extends over the entire width L2 of the sleeping surface, and more preferably, extends substantially parallel to the transversal direction of extension (YY') of the bed 1.

Preferably, the starting point of the separation line (H) is situated between 50% and 80% of the "flat" length L1 of the sleeping surface 3 (which is equal to 2 meters, for instance), preferably between 60% and 75% of said length, and particularly preferentially about 72.5% of said length L1. Said proportions correspond to the ratio of the distance between the head end of the sleeping surface 3 and the seat part separation edge 5S, measured in the flat state, and the total flat length L1 of said sleeping surface 3.

In other words, the surface area of the leg rest preferably represents 20 to 50% of the surface area of the sleeping surface 3, preferably between 25% and 40%, and particularly preferentially about 27.5% of the surface area of the sleeping surface 3.

Furthermore, the leg rest is preferably formed in one piece in terms of kinematics.

Obviously, the seat 5 and the leg rest 6 may nevertheless abut each other at the respective separation edges thereof or may be separated by a gap between said separation edges 5S, 6S.

Thus, the front access to the seat part 5 refers, according to the invention, to the possibility to access the bed and more specifically the sleeping surface 3 by passing the seat part separation edge 5S.

According to the invention, the bed 1 may be arranged to enable the exclusive movement of a mobile seat part 5 with respect to the base 2 and with respect to a stationary leg rest 6 (i.e. a leg rest that is not capable of lateral movement with respect to the base 2), or the exclusive movement of a mobile leg rest 6 with respect to the base 2 and with respect to a stationary seat part 5, or the alternative movement, according to the user's choice, of the seat part 5 or the leg rest 6.

In this respect, the bed may be provided with selective locking means 15, such as pins, enabling reversible locking of the translation of the seat part 5 and/or that of the leg rest 6 with respect to the base 2, especially when the element in question is situated substantially perpendicular to the base 2 and, more specifically, to the upper frame 14.

Preferably, the relative movement of translation of the seat part with respect to the leg rest is substantially rectilinear.

Furthermore, although the direction of relative lateral clearance of the seat part 5 with respect to the leg rest 6 may be situated obliquely with respect to the direction of transverse extension (YY') of the bed 1, said translation movement is preferentially performed substantially parallel with said direction of transverse extension (YY'), i.e. substantially parallel to the ground and perpendicular to the axis of longitudinal extension (XX') of the bed 1.

Moreover, the clearance means 20 are advantageously, according to the invention, provided with a guiding member for performing the guided lateral translation movement, along a predefined captive trajectory, of the seat part 5 and/or the leg rest 6.

Preferably, the relative lateral movement of the leg rest 6 with respect to the seat part makes it possible to reveal the seat part separation edge 5S over at least 50% of the length thereof, which preferably corresponds substantially to the width L2 of the sleeping surface 3, particularly preferentially over at least 66% of the length L2 thereof, and more preferentially over at least 75%, or 90% of the length L2 thereof.

In other words, the clearance means 20 according to the invention make it possible advantageously to offset the leg rest 6 laterally with respect to the seat part 5, or vice versa, so as to change the bed 1 from a first configuration P1, referred to as the "grouped configuration", represented with solid lines in FIG. 1 and wherein the leg rest 6 is situated substantially in the longitudinal extension of the back rest 4 and the seat part 5, to a second configuration P2 referred to as the "clearance configuration", represented with dotted lines in FIG. 1 and wherein the leg rest 6 is offset laterally with respect to the seat part 5 so as to offer direct access to the sleeping surface 3.

Figure 3:
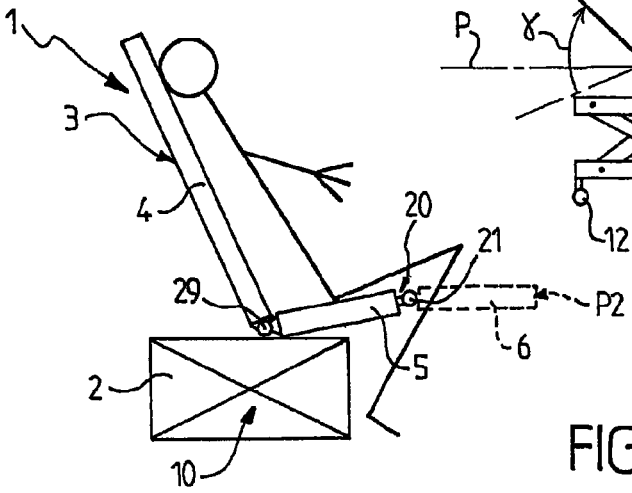
FIG. 3 is a schematic side view of an alternative embodiment of the nursing bed corresponding to that in FIG. 2, but in a configuration allowing a patient to sit and/or to rise from the bed.

Advantageously, as illustrated in FIG. 3, the lateral clearance opens up a front passage enabling the patient to pass their legs over the seat part separation edge 5S and more specifically over the edge formed between the upper surface of the seat part 5 and the corresponding separation edge 5S.

In this way, the patient's legs may either be allowed to hang freely, so as, for instance, to enable the nursing staff to provide care on the feet and calves, or be supported on the ground, after engaging both knees from the front over the separation edge 5S, in order to stand up.

In this context, it should be noted that the lateral clearance means 20, and more generally the bed 1, are arranged such that, in the clearance configuration, the seat part 3 is projecting, i.e. the gap located perpendicular to said seat part 5 offset from the separation edge 5S, i.e. under the patient's thighs, is clear to enable the patient's feet to be placed resting on the ground back from said separation edge 5S, in a natural position minimizing the muscular effort to be provided to get up from the sleeping surface 3.

Therefore, the lateral clearance means 20 according to the invention advantageously consist of standing support means.

Furthermore, it should be noted that, although the lateral clearance means 20 may be arranged to allow complete separation, for example by means of pulling out, of the leg rest 6 and the seat part 5 so as to render said leg rest 6 removable from the bed, the lateral clearance means 20 preferably consist, by design, of a permanent joint rendering the seat part 5 not completely dissociable from the leg rest 6 in normal operation.

The term "seat" refers to the inclination formed by the surface of the seat part 5, whereon the patient sits, with respect to the horizontal reference ground surface, respectively the inclination formed by the surface of the leg rest 6 with respect to said horizontal ground surface.

More specifically, the seat regulating means 21 may be adapted to modify the roll angle, i.e. the angle formed, in a normal plane to the direction of longitudinal extension (XX'), between the projection of the seat part 5 surface and the direction of transverse extension (YY').

Preferably, the seat regulating means 21 are adapted for modifying the seat pitching angle, i.e. the angle formed, in a normal plane to the direction of transverse extension (YY'), by the projection of the seat part 5 surface and the direction of longitudinal extension (XX').

Obviously, the seat regulating means 21 may also be devised to vary the seat of the leg rest 6, for instance when rolling and preferably when pitching, independently from or in conjunction with the seat of the seat part 5.

Although the seat regulating function may optionally be performed using a forward/backward or side tilting mechanism situated between the lower frame 11 and the upper frame 14 and arranged to vary the seat of the sleeping surface 3 overall, the seat regulating means 21 according to the invention will preferably be "specific" to the seat part and/or the leg rest, i.e. separate or independent from such mechanisms to enable, as detailed hereinafter, a modification of the seat of the seat part and/or the leg rest independently from the modification of the seat of the other elements forming the sleeping surface 3.

In particular, the seat regulating means 21 are preferentially devised to vary the seat of the seat part 5 and/or the leg rest 6 with respect to the upper frame 14.

According to a preferential alternative embodiment, the means for clearance with a lateral movement of translation 20 and the seat regulating means 21 have a common member 22 both for guiding the seat part 5, or the leg rest 6 respectively, in lateral movement, and enabling the modification of the seat of said seat part 5, of said leg rest 6.

Particularly advantageously, the common member 22 according to the invention is multifunctional and takes part in terms of kinematics in both the lateral clearance function in translation and the seat regulating function, making it possible to use a single structure, shared by the clearance means 20 and the seat regulating means 21 and thus simplify and lighten the mechanical structure of the bed.

More specifically, the common member 22 may advantageously firstly form a bearing point to support the seat part 5 and/or the leg rest 5 and secondly enable the articulation of the seat part 5 with respect to the upper frame 14 or the leg rest 6 with respect to the seat part 5 and finally guide in translation the seat part 5 with respect to the leg rest 6 and/or the base 2, or the leg rest 6 with respect to the seat part 5.

In other words, the common member 22 may advantageously be inserted between the base 2 and the seat part 5, or between the seat part 5 and the leg rest 6, according to the alternative embodiment selected.

Particularly preferentially, as illustrated in particular in FIGS. 5, 6, 7 and 8, the common member 22 forms a sliding pivot joint wherein the axis ($Y_1Y'_1$) corresponds to the direction of lateral movement of the seat part 5, or of the leg rest 6, i.e. extends substantially parallel to the direction of transverse extension (YY') of the bed 1.

Advantageously, such a solution makes it possible to obtain, by means of a single mechanical joint, both a runner capable of guiding the element of the sleeping surface which is mobile in translation, and a pivot joint enabling the relative tilting of the seat with respect to the leg rest, joined via said mechanical joint.

In this way, advantageously, part of the clearance means 20, and more specifically the guiding member of the clearance means 20, coincides with part of the seat regulating means 21, and more specifically is merged with a hinge member thereof.

Figure 5:
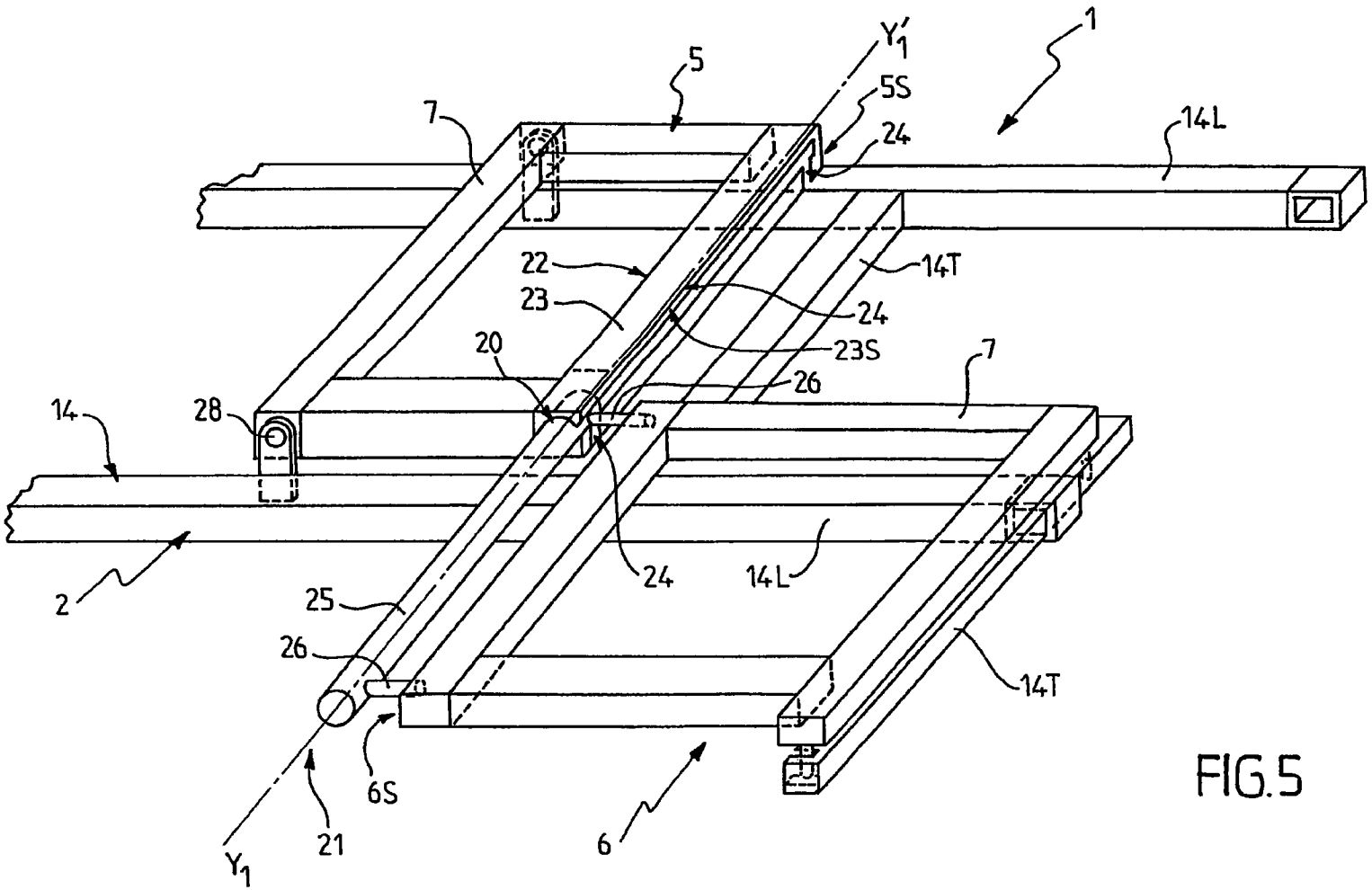
FIG. 5 is a perspective partial view of an alternative embodiment of the nursing bed according to the invention.
Figure 6:
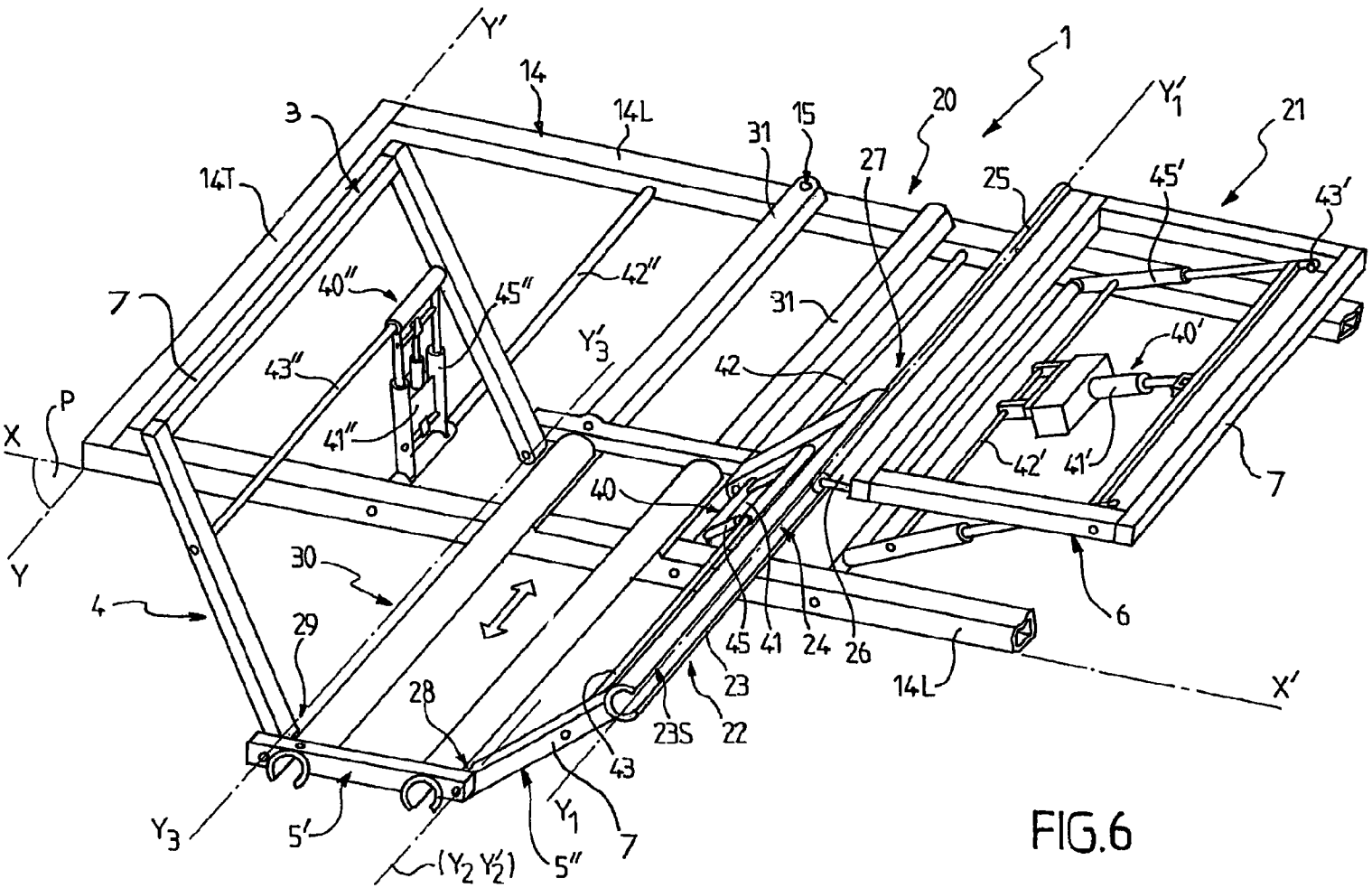
FIG. 6 is a perspective partial view of another alternative embodiment of the nursing bed according to the invention.
Figure 7:
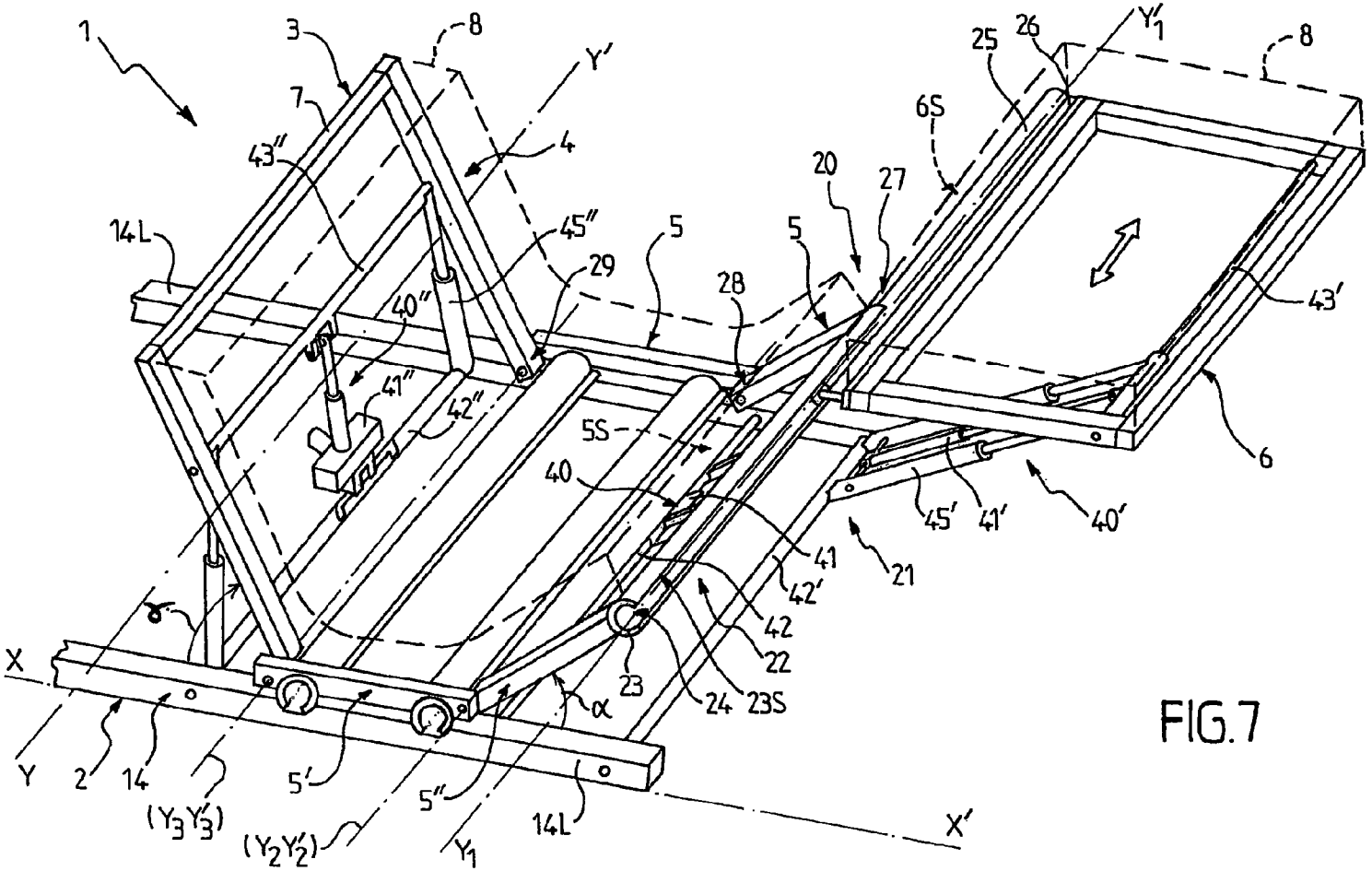
FIG. 7 is a perspective partial view of an alternative embodiment of the nursing bed according to the invention.

More specifically, as particularly illustrated in FIGS. 5 to 7, the common member 22 may comprise firstly a tubular element 23 substantially oriented along the axis ($Y_1Y'_1$) of the sliding pivot joint, said tubular element 23 having one or a plurality of openings 24 provided through the thickness of the wall thereof, and, secondly, a slide 25, such as a billet, arranged to be inserted into said tubular element 23, said slide being provided with one or a plurality of projecting fixing elements 26 devised to pass through the tubular element 23 via the opening(s) 24 so as to connect said slide 25 to a mechanical member of the bed, such as the seat part 5 or leg rest 6, for instance.

Preferably, the tubular element 23 is flared along an elongated cylindrical chamber, having a circular base, forming a casing enabling the displacement in translation and in rotation of the slide 25.

Obviously, the joint between the slide 25 and the tubular element 23 may be made using one or a plurality of smooth bearings, ball bushings, roller cages, or any other equivalent means.

In order to ensure sufficient clearance of the edge 5S of the seat part, the opening 24 preferably extends substantially parallel to the axis ($Y_1Y'_1$) of the sliding pivot joint and extends over the main part, i.e. on at least 50%, preferably on at least 75%, and particularly preferentially on all the length of the tubular element 23.

The opening 24 may in particular be formed by a groove parallel to the generatrix axis of the tubular element.

Figures 8, 9A, 9B:
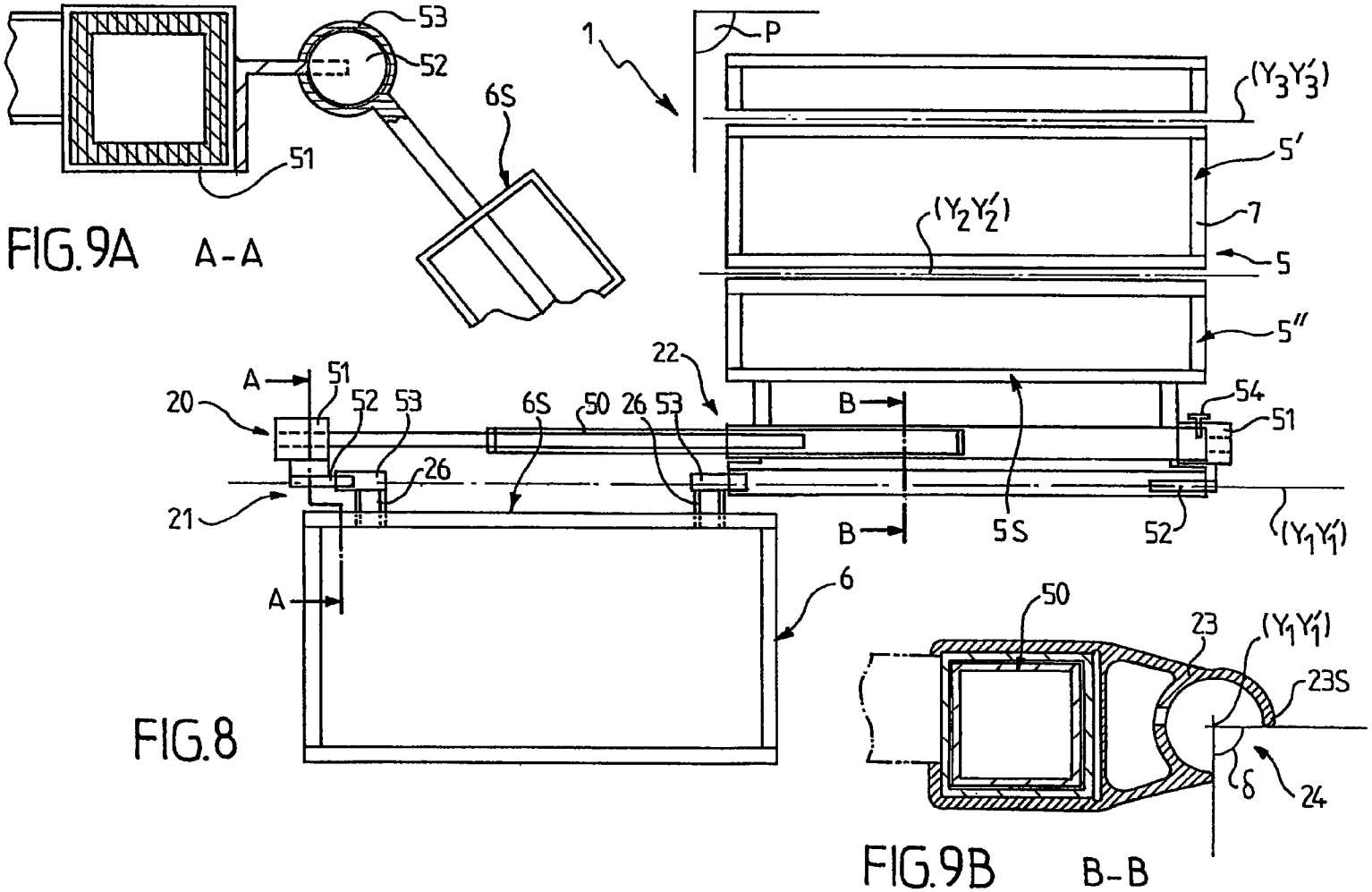
FIG. 8 is a simplified partial top view of an alternative embodiment of the lateral clearance means and the seat regulating means according to the invention.
FIG. 9A is a section along the line A-A illustrating a part of the mechanism represented in FIG. 8.
FIG. 9B is a section along line B-B illustrating a part of the mechanism represented in FIG. 8.

Advantageously, such an arrangement makes it possible not only to benefit from a significant lateral stroke but also makes it possible to produce the tubular element 23 using a profile section, as illustrated in FIG. 9B, and finally to facilitate the assembly and/or removal of the sliding pivot joint for maintenance operations. Advantageously, such a profile may for instance be obtained by means of extrusion.

In order to optimize the robustness and precision of the guiding, said tubular element 23 will preferably extend substantially on the entire width of the sleeping surface 3, and therefore will have a length similar to L2.

Preferably, the common member 22 is also at least partly rigidly connected to the seat part 5.

More specifically, the tubular element 23, or the slide 25, is preferably secured to the bed base portion 7 corresponding to said seat part 5.

In this way, the common member 22 is preferably not dissociable from the seat part 5, and more particularly has at least one part mounted in an embedded joint with the seat part 5, such that all the degrees of freedom between the seat part 5 and the part of the common member 22 in question are removed.

Furthermore, as illustrated in FIGS. 2, 4 and 5 to 8, the seat regulating means 21 preferably comprise a popliteal joint 27 enabling the tilting of the leg rest 6 with respect to the seat part 5.

According to the invention, said popliteal joint 27 is formed by a pivot joint having a substantially horizontal axis parallel with the direction of transverse extension (YY') of the sleeping surface 3, so as to enable the "breaking" of the sleeping surface 3 according to a movement corresponding substantially to the natural bend in the knees.

In this way, the bed 1 according to the invention may offer the patient a comfortable position wherein the continuity of the sleeping surface 3 provides support at the thighs, by means of the seat part 5, and the calves, by means of the leg rest 6. Advantageously, such a comfortable position corresponds to a natural relaxation of the knee joint, without shearing the popliteal space.

Particularly preferentially, the common member 22 forms the popliteal joint 27.

Advantageously, the axis of the popliteal joint 27 may therefore coincide with the lateral clearance axis ($Y_1Y'_1$).

Preferably, the seat regulating means 21 are devised to enable the selection by the user, and particularly by the patient, of the tilting angle β formed between the seat part 5 and the leg rest 6, preferentially on the popliteal joint 27, in a range between 0° and 60° approximately, and preferably between 0° and 90°.

By convention, the tilting angle β corresponds to the angle formed, in a substantially normal plane to the direction of transverse extension (YY'), from the front extension of the projection of the seat part 5 plane to the projection of the leg rest 6 plane, as illustrated in FIG. 4.

It may be envisaged that, as illustrated in FIG. 5, the openings 24 provided in the tubular element 23 only enable free tilting β between the seat part 5 and the leg rest 6 when the bed is in the grouped configuration P1.

In this way, for instance, the opening 24 may comprise, toward the ends of the tubular element 25 substantially vertical and narrow grooves wherein the projecting fixing means 26 can only be inserted when the base portion corresponding to the leg rest 6 is aligned with the base section corresponding to the seat part 5.

However, the seat regulating means 21 and the lateral clearance means 20 are preferably devised to enable holding a tilting angle β between the seat part 5 and the leg rest 6 which is substantially between 50° and 70°, and preferably substantially between 0° and 90°, during the relative lateral movement of the seat part 5 and the leg rest 6.

Advantageously, the tilting angle β held during the relative lateral movement of the seat part 5 and the leg rest 6 may be chosen freely by the user within a predefined range, which enables a direct transition between the grouped configuration and the clearance configuration, even when the sleeping surface 3 is initially in a comfortable position wherein the leg rest 6 is folded down toward the ground with respect to the seat part 5 surface.

To this end, according to a particularly preferential alternative embodiment, the tubular element 23 may comprise a larger opening 24 than that of the projecting fixing elements 26 so as to enable the angular clearance of said fixing elements 26.

In particular, as illustrated in FIG. 6, 7 or 9B, the tubular element 23 may have a "C"-shaped profile having an opening arc 24 wherein the angle at the center of the profile 5 is preferably between 30° and 150°, and particularly preferentially between 60° and 120°.

Such a structural arrangement advantageously enables the fitting of extended fixing means 26 and particularly bearing substantially on the entire width L2 of the leg rest 6, on one hand, and on the entire span provided by the tubular element 23, on the other, while ensuring the free tilting clearance of the leg rest 6 with respect to the seat part 5 irrespective of the lateral offset value between both elements.

In this way, the robustness of the popliteal joint 27 and bed base 7 overall are improved jointly while simplifying and lightening the overall structure of the bed 1.

Advantageously, as illustrated in FIG. 9B, the opening 24 of the tubular element, and more specifically the upper lip 23S of the profile will be arranged such that, when the projecting fixing elements 26 abut against same, the tilting angle β is greater than or equal to zero. In other words, the common member 22, when forming the popliteal joint 27, is preferably devised to prevent the inversion of the bend of the knee, and more specifically to block the clearance of said popliteal joint 27 beyond the clearance of the natural knee joint.

Furthermore, it should be noted that holding a tilting angle β not equal to zero between the seat part 5 and the leg rest 6 makes it possible advantageously to dissociate the edges of the mattress elements 8 corresponding to the separation edges 5S, 6S completely during the relative lateral movement of the seat part 5 and the leg rest 6, making it possible to prevent any friction between said mattresses during translation, and therefore any premature wear, even if said mattresses are thick.

According to a preferential alternative embodiment, the seat regulating means 21 are devised to enable the free selection by the user of the angle of elevation a of the seat part 5 within a range between 0° and 30°, and preferably substantially between −10° and +45°.

By convention, as illustrated in FIG. 4, the angle of elevation α is measured, in a normal projection plane to the direction of transverse extension of the bed (YY'), between the horizontal and the projection of the seat part 5 surface, and counted positively in trigonometric terms.

Preferably, the seat regulating means 21 and the lateral clearance means 20 are arranged to enable the hold of a positive angle of elevation a of the seat part, preferably between 0° and 30°, during the relative lateral movement of the seat part 5 with respect to the leg rest 6.

In this way, advantageously, it is possible to clear the access to the seat part 5 by keeping said seat part raised, i.e. keeping the patient's knees higher than the buttocks so as to retain said patient to prevent any risk of falling by sliding out of the sleeping surface.

It should be noted that the bed according to the invention may thus advantageously enable the free choice of the elevation of the seat part, both in the grouped configuration and in the clearance configuration, or even during the transition between said configurations.

To this end, the seat part 5 is preferably hinged, with respect to the base 2, along a pivot joint having an axis substantially parallel to the direction of transverse extension (YY'), and in particular, may be divided into a "buttock section" 5' and a "thigh section" 5", said thigh section 5" being hinged in a thigh pivot joint 28 having an axis ($Y_2Y_2'$) with said buttock section 5'.

In addition, the seat part 5 and more specifically the buttock section 5' thereof, is preferably hinged with the back rest 4 by means of a buttock pivot joint 29 having an axis ($Y_3Y_3'$) substantially parallel to the direction of transverse extension (YY') of the bed.

More generally, the bed 1 according to the invention may advantageously consist of a single-fold, two-fold or three-fold bed.

In a similar manner to that described above, the seat regulating means 21 are preferably devised to enable the straightening of the back rest 4 with respect to the seat part 5, about the axis ($Y_3Y_3'$), along a straightening angle γ substantially between 0° and 90°, and at least between 0° and 45°.

By convention, the straightening angle γ corresponds to the angle formed, in a substantially normal plane to the direction of transverse extension (YY'), from the rear extension of the projection of the seat part 5 surface to the projection of the leg rest 6 plane, as illustrated in FIG. 4.

In this context, it should be noted that, the straightening angle γ of the back rest 4 being measured relative to the seat part 5 surface (as for the tilting angle β of the leg rest 6), adjusting a positive angle of seat part elevation α, for example +10° combined with the selection of a zero straightening angle γ (i.e. the back rest plane is placed substantially in the alignment of the seat part 5 surface) consists of placing the sleeping surface 3 in a backward tilted position. It may thus be envisaged that the seat regulating means 21 fulfill the forward/backward tilting functions, making it possible to simplify the structure of the bed 1 and reduce the production cost thereof.

Particularly preferentially, the seat regulating means 21 and the lateral clearance means 20 are devised to enable the adjustment of the angle of elevation α of the seat part 5, or of the straightening angle γ of the back rest 4, when the bed 1 is in the clearance configuration, i.e. these comfort adjustments remain available even when the leg rest 6 has been moved away from the seat part 5 and the patient's legs no longer rest thereon.

Preferably, the seat regulating and lateral clearance means are devised to enable the independent adjustment of both the angle of elevation α of the seat part 5 and the straightening angle γ of the back rest 4 when the bed is in the clearance configuration.

In this way, the patient may advantageously have an adjustable and accessible chair when the bed is in the clearance configuration.

According to an alternative embodiment illustrated in FIG. 7, the movement of a mobile leg rest 6 with respect to a base 2 and a seat part 5 remaining perpendicular to said base 2 is advantageously enabled, irrespective of the angle of elevation of the seat part and the tilting angle of the leg rest, using shortened longitudinal beams 14L of the upper frame 14, which are discontinued substantially perpendicular to the popliteal joint 27. This structural arrangement advantageously makes it possible to pass the upper frame over the leg rest 6 without striking the longitudinal beams 14L and without having to raise the frame of the seat part beforehand, in order to position same entirely above said beams 14L.

According to one alternative embodiment not shown, the upper longitudinal beams 14L may have a longitudinally mobile and more specifically extendable, for instance, telescopic, structure, so as to be able to be deployed to support the sleeping surface 3 when the bed is in the grouped configuration and to retract so as to clear the passage for the leg rest 6 during the transition to the clearance configuration.

Furthermore, according to an alternative embodiment illustrated in FIG. 6, the seat part 5, and preferably the back rest 4, are mounted on a mobile trolley 30 guided in lateral translation with respect to the upper frame 14, for example by means of one or a plurality of rails 31.

It should be noted that, in order to rationalize production, it may be envisaged to use, as a support for said trolley 30, two rails using profiles and billets identical to those used to form the tubular element 23 and the slide 25 forming the common member 22.

According to such an alternative embodiment, provided that, firstly, the seat part 5 is offset laterally to have the edge 5S thereof overhanging on the left or right of the base, and more specifically overhanging from the upper frame 14, and, secondly, where the leg rest 6 remains perpendicular to said base 2 during the clearance operations, it is perfectly possible to retain any tilting angle β, irrespective of the (positive) angle of elevation α selected for the seat part.

Indeed, provided that the leg rest 6 does not need to be moved laterally, the upper frame 14 does not represent an obstacle, and the leg rest 6 may therefore be inclined toward the ground before and during the movement of the mobile trolley 30 without impeding said movement.

In other words, it is possible, using the bed according to the invention, to place the patient in the sitting position in a chair (similar to a "recliner" in the grouped configuration), and then to transfer the patient laterally, still in the sitting position, so as to progressively free the patient's legs from the support of the leg rest, and have the patient regain natural support under the seat part, from the same seat configuration, in order to assist the patient in getting up. The nursing staff's task is thus simplified greatly.

Advantageously, the bed 1 according to the invention makes it possible to retain the comfort settings, i.e. more specifically the settings of the angle of elevation α of the seat part 5, tilting angle β of the leg rest 6 and straightening angle γ of the back rest 4, operational at any time, whether the bed is in the grouped configuration or in the clearance configuration.

In addition, the seat, and therefore comfort, regulating means according to the invention may advantageously be independent from each other and independent from the retracted or clearance configuration of the bed 1.

Furthermore, in order to ensure the holding in position and/or the actuation of the various hinged elements mentioned above, the seat regulating means 21 preferably comprise one or a plurality of support members 40, 40', 40" of variable length, such as cylinders 41, 41', 41" or notched rods, each connecting a support element 42, 42', 42" rigidly connected to the base 2 to a respective lift element 43, 43', 43" rigidly connected to the seat part 5 and/or the leg rest 6 and/or the back rest 4.

As illustrated in FIGS. 6 and 7, the support elements 42, 42', 42" may advantageously be formed by rods transversally joining the longitudinal beams 14L of the upper frame 14, substantially parallel to the transverse direction (YY') of the bed 1.

Similarly, the lift elements 43, 43', 43" may advantageously be formed by rods transversally joining the lateral elements of the portions of the bed base 7 corresponding respectively to the seat part, leg rest and back rest, substantially parallel to the transverse direction (YY') of the bed 1.

Obviously, the support elements will be positioned at a height below that of the junction of the points of the respective pivot joints of the seat part, leg rest or back rest, so as to create triangular structures enabling the appearance of a lifting torque capable of lifting the lift elements.

In this context, the support elements may optionally be surbased to enable clearance of an element of the sleeping surface 3, such as the leg rest 6 or back rest 4, below the level of the upper frame 14.

Particularly preferentially, the support member 40, 40', 40" is mounted mobile in translation, and more specifically in a sliding pivot, with respect to the support element 42, 42', 42" and/or the lift element 43, 43', 43" so as to be able to accompany at least partially the lateral movement of the leg rest 6 with respect to seat part 5 or vice versa.

Preferably, the mobility in translation is free, such that the support member 40, 40', 40" is spontaneously carried in movement by the mobile element (seat part or leg rest) when said element abuts against said support means during the transition thereof from the grouped configuration to the clearance configuration.

It should be noted that, in this context, the combined use of two differential movements in lateral translation, one with respect to the support element 42, 42', 42" and the other with respect to the lift element 43, 43', 43", advantageously makes it possible to maximize the relative stroke of the seat part 5 with respect to the leg rest 6 by minimizing the residual space requirement of the joint formed by the support member 40, 40', 40".

Preferably, the support member 40, 40', 40" is provided with a guiding reinforcement 45, 45', 45" to prevent the flexion or buttressing of said support member during the movements thereof with respect to the support element 42, 42', 42" and/or the lift element 43, 43', 43".

Obviously, so as not to impede the primary function of the support member, said guiding member 45, 45', 45" is extendable, and retractable, along the same direction as said support member.

Particularly preferentially, as illustrated in FIGS. 6 and 7, the guiding reinforcement 45, 45', 45" is formed by a telescopic frame.

Obviously, the width of the telescopic frames is not limited, and may particularly vary according to whether the element of the sleeping surface associated with the corresponding support means is intended to be laterally mobile or, on the contrary, stationary. In the latter case, the telescopic frame may advantageously extend over the entire width of the space between the longitudinal beams 14L to form an abutment blocking the lateral translation of the corresponding element of the sleeping surface with respect to the base, as in the case of the telescopic frame 45' associated with the leg rest 6 in FIG. 6.

Furthermore, as illustrated in FIGS. 6, 7 and 8, the means for clearance with a lateral movement of translation 21 are preferably two-directional and arranged to enable alternately the movement of the seat part 5 and/or the leg rest 6 on the left-hand side or right-hand side of the bed, as desired by the user or according to temporary or long-term space constraints associated with the configuration of the room wherein the bed 1 is installed.

Therefore, such a bed offers highly polyvalent use.

As illustrated in FIG. 8, such two-directional clearance means may comprise, firstly, a telescopic accompanying rod 50 and, secondly, mobile hinge plates 51, devised to be alternately moved and removed by the end section of said telescopic rod 50, to accompany the movement of shanks 53 secured to the leg rest supported by means of hinge pins 52.

Such an arrangement makes it possible to reinforce the mechanical strength of the joint between the seat part and the leg rest.

Furthermore, according to an alternative embodiment not shown, the seat part 5 and the leg rest 6 may be dissociable, for instance on the popliteal joint.

To this end, the sleeping surface 3, and more specifically the bed base 7, may be provided with reversible joint members, secured respectively to the seat part 5 and the leg rest 6, and for instance situated substantially on the respective separation edges thereof.

Said joint members are devised to be alternately coupled, according to an association configuration wherein they produce a mechanical joint, for instance, of the embedded or pivot joint type (in this instance, popliteal), and separated, according to a dissociation configuration wherein the degree(s) of freedom removed in the association configuration are restored, i.e. wherein the direct joint existing between the seat part and the leg rest is removed.

In other words, it is possible alternately to dissociate or reconstitute the sleeping surface 3, and more specifically the bed base 7, when the bed is in the grouped configuration.

According to such an alternative embodiment, it is possible to "release" the leg rest on the base 2 before switching the bed to the clearance configuration.

More specifically, it may be envisaged to rest the leg rest 6 on the upper frame 14, and dissociate same from the seat part 5, such that the leg rest is left (and maintained) substantially flat on said frame while the seat part 5 is moved in translation outward.

Advantageously, it is also possible to envisage stowage means arranged to block the lateral clearance of the leg rest 6 when said leg rest is no longer connected directly to the seat part 5.

Preferably, according to such an alternative embodiment, the seat part is provided with specific seat regulating means making it possible to increase the angle of elevation thereof, i.e. tilt the seat slightly backwards so as to raise the separation edge 5S thereof above the separation edge 6S of the leg rest when performing the lateral translation.

The operation of a bed 1 according to the invention will now be described briefly, with reference to an alternative embodiment substantially similar to that in FIG. 6, but comprising telescopic upper longitudinal beams 14L (not shown) to clear the gap situated in the lateral extension of the popliteal joint 27.

Initially, the patient lies flat on the sleeping surface 3. The angle of elevation $\alpha$, tilting angle $\beta$ and straightening angle $\gamma$ are all substantially zero.

If the patient wishes to change to the sitting position, the leg rest 6 is lowered, i.e. the tilting angle $\beta$ is increased, by returning the corresponding lift element 43' downward by retracting the rod of the cylinder 41'.

At the same time, the patient raises the back rest 4, i.e. increases the straightening angle $\gamma$, by deploying the cylinder 41" which pushes back the corresponding lift element 43" with respect to the support element 42".

In this context, the various members of the seat regulating means 21 may advantageously be controlled electronically to offer joint and coordinated operation of a plurality of constituent elements of the sleeping surface 3, according to the desired configuration (bed, seat, clearance, etc.).

Using this chair (or "recliner") type grouped configuration, a member of nursing staff can help the patient get up, or access the back of the legs to provide care, according to the following procedure.

Firstly, the member of nursing staff raises the seat part 5 slightly to the rear by raising the thigh section 5" and tilting same about the thigh joint 28, i.e. increases the angle of elevation a by deploying the corresponding cylinder 41.

During this raising, the leg rest 6 is moved following the seat part 5 via the popliteal joint 27. The pivot joints provided between the support member 40' of the leg rest 6, on one hand, and the corresponding support 42' and lift elements 43', on the other, advantageously enable the movement to develop, by forming with the seat part 5 and the upper frame 14 a structure similar to a parallelogram. Obviously, it may be further envisaged to control the cylinder 41', associated with the leg rest 6, with the cylinder 41 which actuates the seat part 5 so as to preserve the tilting angle $\beta$ during the raising of said seat part 5.

Once the seat part has been raised, for example by 10°, 20° or 30°, the member of nursing staff retracts the telescopic upper longitudinal beam 14L situated on the side corresponding to the envisaged direction of clearance (for instance on the right of the bed) so as to clear the lateral passage for the patient's legs when the legs leave the leg rest.

The member of nursing staff then unlocks the mobile trolley 30 by removing the locking pin 15, and pulls on said trolley 30, for instance on a side handle (not shown) specially provided for this purpose on the side edge of the bed base 7.

The member of nursing staff may thus extract the trolley 30 projecting from the side of the bed 1, and more specifically overhanging with respect to the base 2, by sliding same progressively along the rails 31, for instance to the right in FIG. 6.

When the trolley is moved 30, it moves the seat part 5 and the back rest 4 supported, whereas the leg rest 6 remains stationary, perpendicular to the base 2, held by the frame 45' of the support means 40' which abuts on the inner face of the right-hand side longitudinal beam 14L. This results in a relative movement of the tubular element 23 which is progressively freed from the billet 25 by sliding along same, at a constant height, to follow the seat part.

When the frame of the seat part 5 strikes the upper part (and more specifically the outside of the left jamb) of the telescopic frame 45 mounting the support cylinder 41 associated with said seat part, said frame 45 is moved in translation along the support rod 42, until the outside of the right jamb thereof strikes the inner edge of the right-hand side upper longitudinal beam 14L. The telescopic frame 45 may thus advantageously form a limit abutment preventing, for instance, the trolley 30 from being accidentally completely pulled out from the rails 31 thereof.

The bed is then in the clearance configuration, as illustrated in FIG. 6.

Obviously, the patient is moved at the same time as the seat part 5 whereon the patient is located, such that the patient's legs are progressively pulled to the side away from the leg rest 6 until they hang freely over the separation edge 5S.

If applicable, the member of nursing staff may then adjust the overall height of the seat part using the lifting means 10 so as to bring the patient's feet to ground level, so that the patient regains a natural and stable support.

Furthermore, it may be envisaged to concomitantly place the seat part in the forward tilting position, i.e. give said seat part a negative angle of elevation $\alpha$, so as to "push" the patient from the seat.

In this way, the bed 1 according to the invention offers great simplicity, both in terms of structure and use, and ensures the safety of the patient and nursing personnel.

Furthermore, the bed helps improve quality of life in a nursing environment, both by facilitating patient mobility and activity and simplifying care.

In particular, such a bed may offer a genuine seat, or chair, position, wherein the patient is fully supported on the back and thighs, while benefiting from clearance of the back portion of the legs.

Such an arrangement facilitates not only the patient getting up, without any obstruction for said patient or harmful back position for the assisting nursing staff, but also provides direct access to the calves and heels such that the member of nursing staff has both hands free to provide care, without it being necessary to raise and hold the patient's legs above the mattress.

Therefore, the ergonomics of the bed according to the invention are excellent.

Finally, the bed according to the invention is capable, if applicable, to substantially keep the seat of the leg rest horizontal during the front clearance of the seat part, thus preventing bed linen from falling and in any case protecting same from unhygienic contact with the ground.

INDUSTRIAL APPLICABILITY

The invention is industrially applicable in the design and manufacture of nursing beds.

The invention claimed is:

1. Nursing bed (1) comprising a base (2) supported on the ground and a sleeping surface (3) supported by said base (2) and comprising a back rest (4), a seat part (5) and a leg rest (6), said nursing bed being characterized in that it comprises means for clearance with a lateral movement of translation (20), used to enable the leg rest (6) to move laterally in relation to the seat part (5), or vice versa, the seat part (5) in relation to the leg rest (6), according to a movement of translation oriented in a direction which is essentially transversal to the sleeping surface (3), in such a way as to clear the front access to said seat part (5), and seat regulating means (21) for varying the seat of the seat part (5) and/or the leg rest (6) in relation to the ground.

2. Nursing bed according to claim 1 in which said means for clearance with a lateral movement of translation (20) and the seat regulating means (21) have a common member (22) both for guiding the seat part (5), or the leg rest (6), in lateral movement, and enabling the modification of the seat of said seat part (5), or of said leg rest respectively.

3. Nursing bed according to claim 2 in which said common member (22) forms a sliding pivot joint wherein the axis (Y1Y1') corresponds to the direction of lateral movement of the seat part (5), or of the leg rest (6) respectively.

4. Nursing bed according to claim 3 in which said common member (22) comprises firstly a tubular element (23) substantially oriented along the axis ($Y_1Y_1'$) of the sliding pivot joint and having one or a plurality of openings (24) provided through the thickness of the wall thereof, and, secondly, a slide (25), such as a billet, arranged to be inserted into said tubular element (23), said slide being provided with one or a plurality of projecting fixing elements (26) devised to pass through the tubular element (23) via the opening(s) (24) so as to connect said slide (25) to a mechanical member of the bed, such as the seat part (5) or leg rest (6).

5. Nursing bed according to claim 4 in which said opening (24) extends substantially parallel to the axis ($Y_1Y_1'$) of the sliding pivot joint and extends over the main part, and preferably all, of the length of the tubular element (23).

6. Nursing bed according to claim 2 in which said common member (22) is at least partly rigidly connected to the seat part (5).

7. Nursing bed according to claim 1 in which said seat regulating means (21) comprise a popliteal joint (27) enabling the tilting of the leg rest (6) with respect to the seat part (5).

8. Nursing bed according to claim 7 in which said common member (22) forms the popliteal joint (27).

9. Nursing bed according to claim 7 in which said seat regulating means (21) are devised to enable the free selection by the user of the tilting angle (13) formed between the seat part (5) and the leg rest (6) within a range between 0° and 60°, and preferably between 0° and 90°.

10. Nursing bed according to claim 7 in which said seat regulating means (21) and the lateral clearance means (20) are devised to enable holding a tilting angle (13) between the seat part and the leg rest substantially between 50° and 70°, and preferably substantially between 0° and 90°, during the relative lateral movement of the seat part (5) with respect to the leg rest (6).

11. Nursing bed according to claim 1 in which said seat regulating means (21) are devised to enable the free selection by the user of the angle of elevation (a) of the seat part (5) within a range between 0° and 30°, and preferably substantially between −10° and +45°.

12. Nursing bed according to claim 1 in which said seat regulating means (21) and the lateral clearance means (20) are arranged to enable holding a positive angle of elevation (a) of the seat part (5), preferably between 0° and 30°, during the relative lateral movement of said seat part with respect to the leg rest.

13. Nursing bed according to claim 1 in which said seat regulating means (21) are devised to enable the straightening of the back rest (4) with respect to the seat part (5), along a straightening angle (γ) substantially between 0° and 45°, and preferably between 0° and 90°.

14. Nursing bed according to claim 1 in which said seat regulating means (21) and the lateral clearance means (20) are devised to enable the adjustment of the angle of elevation (α) of the seat part (5) and/or the straightening angle (γ) of the back rest (4) when the bed is in the open configuration, the front access to the seat part being cleared.

15. Nursing bed according to claim 1 in which said seat regulating means (21) comprise one or a plurality of support members (40, 40', 40") of variable length, including cylinders (41, 41', 41") or notched rods, each connecting a support element (42, 42', 42") rigidly connected to the base (2) to a respective lift element (43, 43', 43") rigidly connected to the seat part (5) and/or the leg rest (6).

16. Nursing bed according to claim 15 in which said support member (40, 40', 40") is mounted mobile in translation with respect to the support element (42, 42', 42") and/or the lift element (43, 43', 43") so as to be able to accompany at least partially the lateral movement of the leg rest (6) with respect to seat part (5) or vice versa.

17. Nursing bed according to claim 16 in which said support member (40, 40', 40") is provided with a guiding reinforcement (45, 45', 45") to prevent the flexion or buttressing of said support member during the movements thereof with respect to the support element (42, 42', 42") and/or the lift element (43, 43', 43"), said guiding member (45, 45', 45") being extendable along the same direction as the support member.

18. Nursing bed according to claim 17 in which said guiding reinforcement (45, 45', 45") is formed by a telescopic frame.

19. Nursing bed according to claim 1 in which said means for clearance with a lateral movement of translation (21) are two-directional and arranged to enable alternately the movement of the seat part (5) and/or the leg rest (6) on the left-hand side or right-hand side of the bed.

20. Nursing bed according to claim 1 in which said base (2) comprises a lower frame (11) supported on the ground, an upper frame (14) whereon the sleeping surface (3) is fastened, and lifting means (10) providing the vertical mobility of the upper frame (14) with respect to the lower frame (11), the seat regulating means (21) being used to vary the seat of the seat part (5) and/or the leg rest (6) with respect to said upper frame (14).

* * * * *